US008403634B2

(12) United States Patent
Arness et al.

(10) Patent No.: US 8,403,634 B2
(45) Date of Patent: Mar. 26, 2013

(54) SEAL ASSEMBLY FOR USE WITH TURBINE NOZZLES

(75) Inventors: Brian P. Arness, Simpsonville, SC (US); John E. Greene, Greenville, SC (US); Sze Bun B. Chan, Greer, SC (US)

(73) Assignee: General Electric Company, Schenectady, NY (US)

( * ) Notice: Subject to any disclaimer, the term of this patent is extended or adjusted under 35 U.S.C. 154(b) by 1 day.

(21) Appl. No.: 13/216,347

(22) Filed: Aug. 24, 2011

(65) Prior Publication Data

US 2011/0311353 A1 Dec. 22, 2011

Related U.S. Application Data

(62) Division of application No. 11/325,185, filed on Jan. 4, 2006, now Pat. No. 8,038,389.

(51) Int. Cl.
*F01D 9/04* (2006.01)

(52) U.S. Cl. ..... 415/135; 415/136; 415/190; 415/189; 415/209.2; 415/209.4; 415/210.1; 60/752; 60/796; 60/800

(58) Field of Classification Search ..... 415/135–136, 415/138–139, 189–190, 209.2, 209.3, 209.4, 415/210.1; 60/752, 796, 800
See application file for complete search history.

(56) References Cited

U.S. PATENT DOCUMENTS

| | | | |
|---|---|---|---|
| 3,759,038 | A | 9/1973 | Scalzo et al. |
| 4,454,711 | A | 6/1984 | Ben-Porat |
| 5,271,220 | A | 12/1993 | Holmes et al. |
| 5,343,694 | A | 9/1994 | Toborg et al. |
| 5,459,995 | A | 10/1995 | Norton et al. |
| 5,591,003 | A | 1/1997 | Boyd et al. |
| 5,743,711 | A | 4/1998 | Fournier et al. |
| 6,102,466 | A | 8/2000 | Kanazawa et al. |
| 6,537,023 | B1 | 3/2003 | Aksit et al. |
| 6,658,853 | B2 | 12/2003 | Matsuda et al. |
| 6,668,559 | B2 | 12/2003 | Calvez et al. |
| 6,675,584 | B1 | 1/2004 | Hollis et al. |
| 6,679,062 | B2 | 1/2004 | Conete et al. |
| 6,752,592 | B2 | 6/2004 | Mohammed-Fakir et al. |
| 6,823,676 | B2 | 11/2004 | Conete et al. |
| 6,921,034 | B2 | 7/2005 | Koss |
| 7,094,025 | B2 | 8/2006 | Arness et al. |
| 7,094,026 | B2 | 8/2006 | Coign et al. |
| 7,527,469 | B2 | 5/2009 | Zborovsky et al. |
| 2011/0020118 | A1* | 1/2011 | Smoke et al. ..... 415/191 |

FOREIGN PATENT DOCUMENTS

| | | | |
|---|---|---|---|
| EP | 0526058 | A1 | 2/1993 |
| FR | 2825782 | A1 | 6/2001 |
| JP | 59085429 | A | 5/1984 |
| JP | 05156967 | A | 6/1993 |
| JP | 2004052755 | A | 2/2004 |
| JP | 2005009479 | A | 1/2005 |
| WO | 2005111380 | A1 | 11/2005 |

* cited by examiner

*Primary Examiner* — Christopher Verdier
(74) *Attorney, Agent, or Firm* — Armstrong Teasdale LLP

(57) ABSTRACT

A retaining seal assembly for use in a gas turbine engine is provided. The retaining seal assembly comprises an outer retaining ring coupled to an aft end of a gas turbine engine combustor. A turbine nozzle is coupled to the outer retaining ring and comprises an outer band. The outer band comprises a leading edge and an opposing trailing edge that defines a slot. A retention seal comprises a first end positioned within the slot, a generally opposing second end that contacts the outer retaining ring, and a body extending between the first end and the second end. The body further comprises an insertion portion positioned within a passage formed in the outer band. The retention seal is fabricated from a resilient material and is configured to facilitate coupling the turbine nozzle to the outer retaining ring.

8 Claims, 7 Drawing Sheets

SEAL ASSEMBLY FOR USE WITH TURBINE NOZZLES

CROSS REFERENCE TO RELATED APPLICATIONS

This application is a divisional of prior application Ser. No. 11/325,185 filed Jan. 4, 2006, now U.S. Pat. No. 8,038,389, which is hereby incorporated by reference.

BACKGROUND OF THE INVENTION

This invention relates generally to turbine engines and, more particularly, to methods and apparatus for assembling a turbine nozzle assembly.

Known gas turbine engines include combustors that ignite fuel-air mixtures, which are then channeled through a turbine nozzle assembly towards a turbine. At least some known turbine nozzle assemblies include a plurality of arcuate nozzle segments arranged circumferentially about an aft end of the combustor. At least some known turbine nozzles include a plurality of circumferentially-spaced hollow airfoil vanes coupled between an inner band platform and an outer band platform. More specifically, the inner band platform forms a portion of the radially inner flowpath boundary and the outer band platform forms a portion of the radially outer flowpath boundary.

An aft region of the inner band platform and/or the outer band platform of the nozzle segment is a critical region limiting performance due to inadequate cooling. Conventional nozzle segments utilize sealing configurations that allow high pressure air along a length of the inner band platform and/or the outer band platform. However, such conventional sealing configurations are prime reliant, e.g., if a seal fails, the entire sealing configuration will fail. Further, conventional attachment methods utilized to construct the conventional turbine nozzle segments are not conducive to easy maintenance.

BRIEF DESCRIPTION OF THE INVENTION

In one aspect, a method for assembling a turbine nozzle assembly with respect to a combustor of a gas turbine engine is provided. The method includes coupling a radial outer retaining ring to an aft end of the combustor. A plurality of turbine nozzles is provided. Each turbine nozzle includes an inner band, a radially opposing outer band, and at least one vane extending between the inner band and the outer band. The outer band of each turbine nozzle is coupled to the outer retaining ring. An inner retaining ring is positioned about an axis of the gas turbine engine and coupled to the inner band of each turbine nozzle to define the turbine nozzle assembly.

In another aspect, a retaining assembly for retaining a turbine nozzle assembly positioned with respect to a combustor of a gas turbine engine is provided. The retaining assembly includes a radial outer retaining ring coupled to an aft end of the combustor. A radial inner retaining ring is fixedly positioned circumferentially about a center axis of the gas turbine engine. A plurality of turbine nozzles is positioned circumferentially about the inner retaining ring to define the turbine nozzle assembly. Each turbine nozzle includes an inner band coupled to the inner retaining ring, an outer band coupled to the outer retaining ring, and at least one vane extending between the inner band and the outer band.

In another aspect, a retention seal assembly is provided. The retention seal includes an outer retaining ring coupled to an aft end of a gas turbine engine combustor. A turbine nozzle is coupled to the outer retaining ring. The turbine nozzle includes an outer band that has a leading edge and an opposing trailing edge. The trailing edge defines a slot. A retention seal includes a first end that is positioned within the slot. A generally opposing second end contacts the outer retaining ring. A body extends between the first end and the second end. The retention seal is fabricated from a resilient material and is configured to facilitate coupling the turbine nozzle to the outer retaining ring.

DETAILED DESCRIPTION OF THE INVENTION

The present invention provides a method and apparatus for coupling a turbine nozzle assembly with respect to a combustor section of a gas turbine engine. Although the present invention is described below in reference to its application in connection with and operation of a stationary gas turbine engine, it will be obvious to those skilled in the art and guided by the teachings herein provided that the invention is likewise applicable to any combustion device including, without limitation, boilers, heaters and other gas turbine engines, and may be applied to systems consuming natural gas, fuel, coal, oil or any solid, liquid or gaseous fuel.

Figure 1:
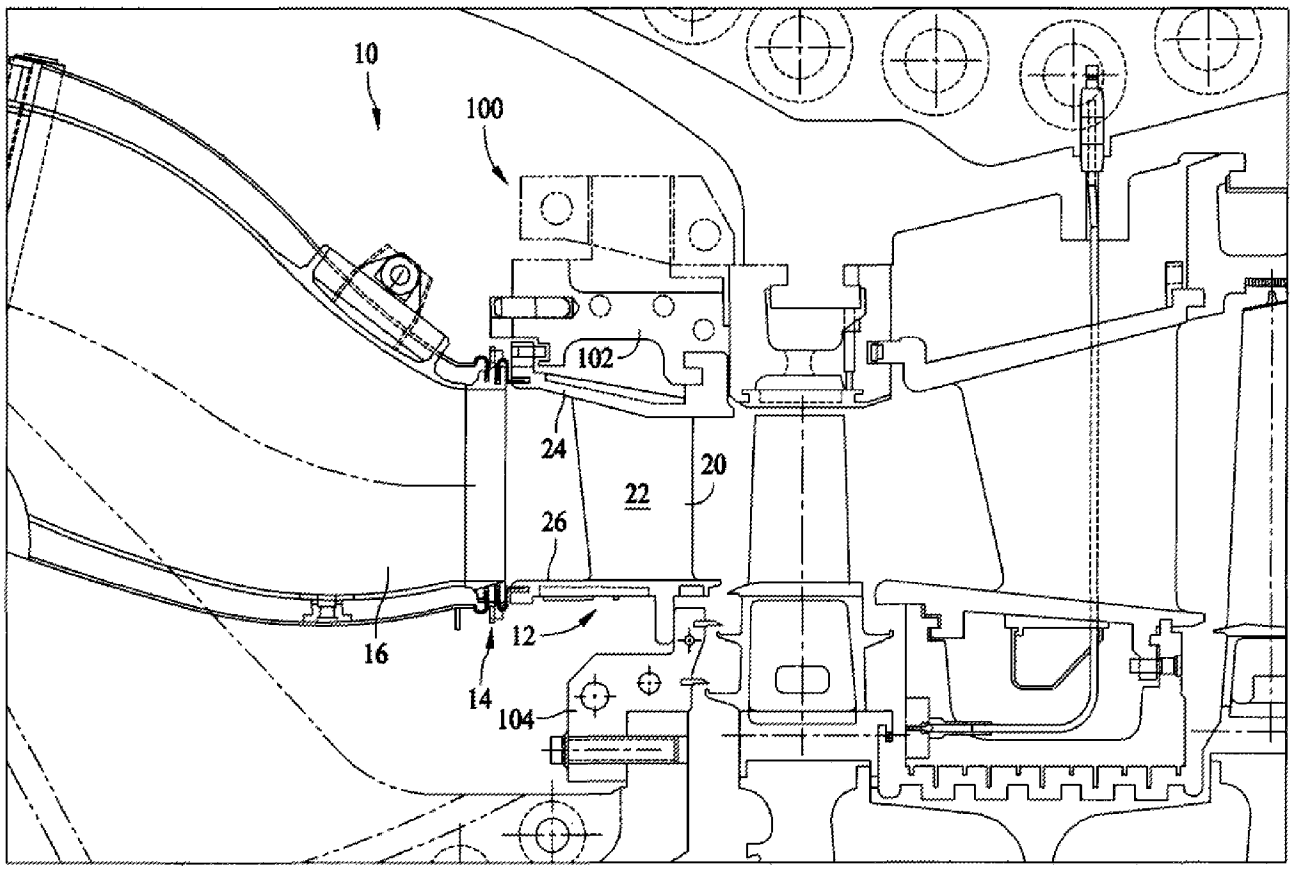
FIG. 1 is a partial schematic view of an exemplary gas turbine engine.

FIG. 1 is a partial sectional view of an exemplary gas turbine engine 10. In one embodiment, gas turbine system 10 includes a compressor, a turbine and a generator arranged along a single monolithic rotor or shaft. In an alternative embodiment, the shaft is segmented into a plurality of shaft segments, wherein each shaft segment is coupled to an adjacent shaft segment to form the shaft. The compressor supplies compressed air to a combustor, wherein the air is mixed with fuel supplied thereto. In one embodiment, gas turbine engine 10 is a 7FA+e gas turbine engine commercially available from General Electric Company, Greenville, S.C. The present invention is not limited to any particular gas turbine engine and may be implemented in connection with other gas turbine engine models including, for example, the MS6001FA (6FA), MS6001B (6B), MS6001C (6C), MS7001FA (7FA), MS7001FB (7FB), MS9001FA (9FA) and MS9001FB (9FB) models of General Electric Company.

In operation, air flows through the compressor supplying compressed air to the combustor. Combustion gases from the combustor drive the turbines. The turbines rotate the shaft, the compressor and the electric generator about a longitudinal center axis (not shown) of gas turbine engine 10. As shown in FIG. 1, gas turbine engine 10 includes a turbine nozzle assembly 12 coupled to an aft end 14 of a combustor duct 16. In one embodiment, turbine nozzle assembly 12 includes a plurality of turbine nozzles 20 circumferentially positioned about the center axis of gas turbine engine 10 to form turbine nozzle assembly 12 within gas turbine engine 10.

Figure 2:
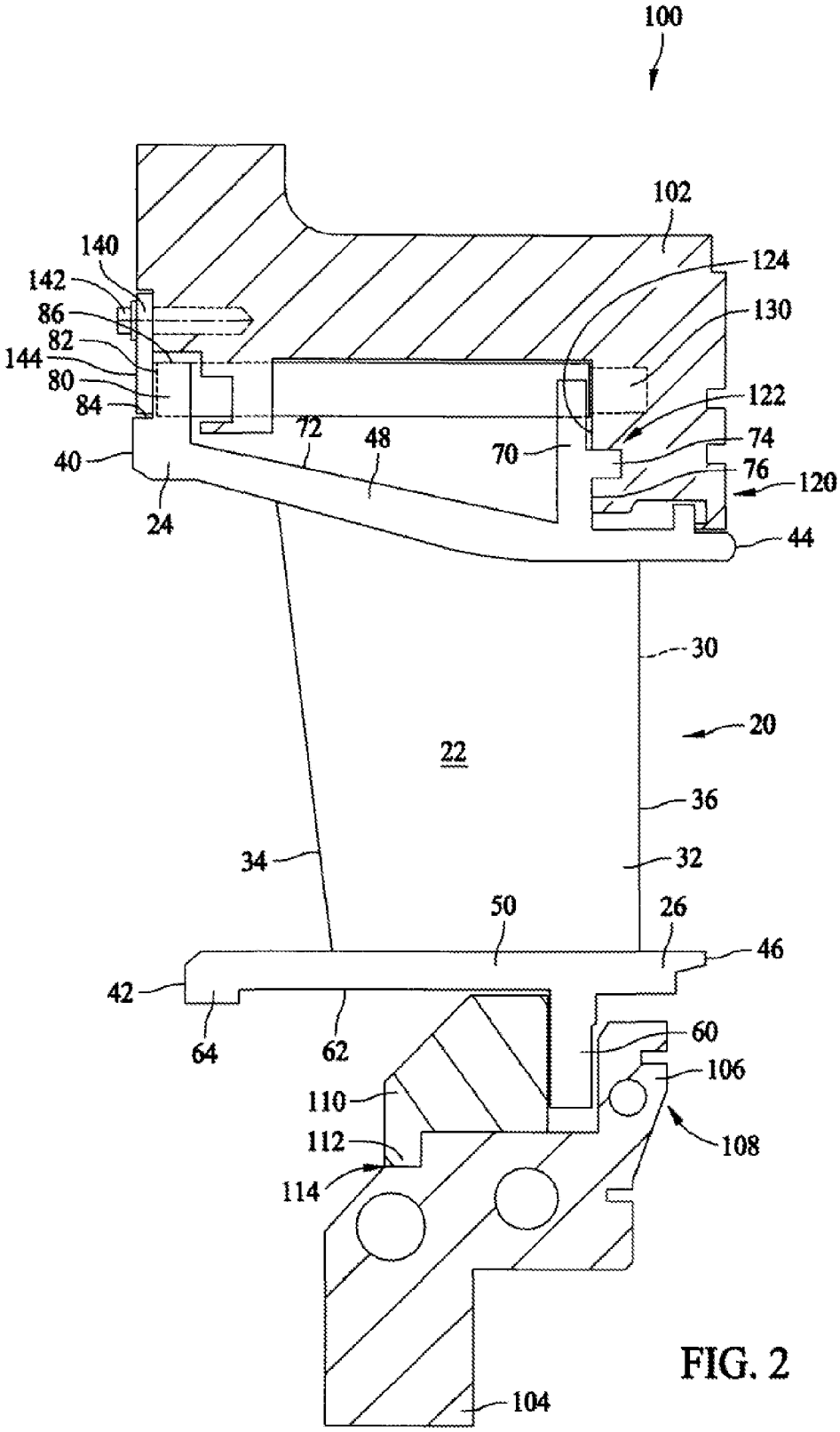
FIG. 2 is a partial sectional side view of an exemplary turbine nozzle that may be used with the gas turbine engine shown in FIG. 1.
Figure 3:
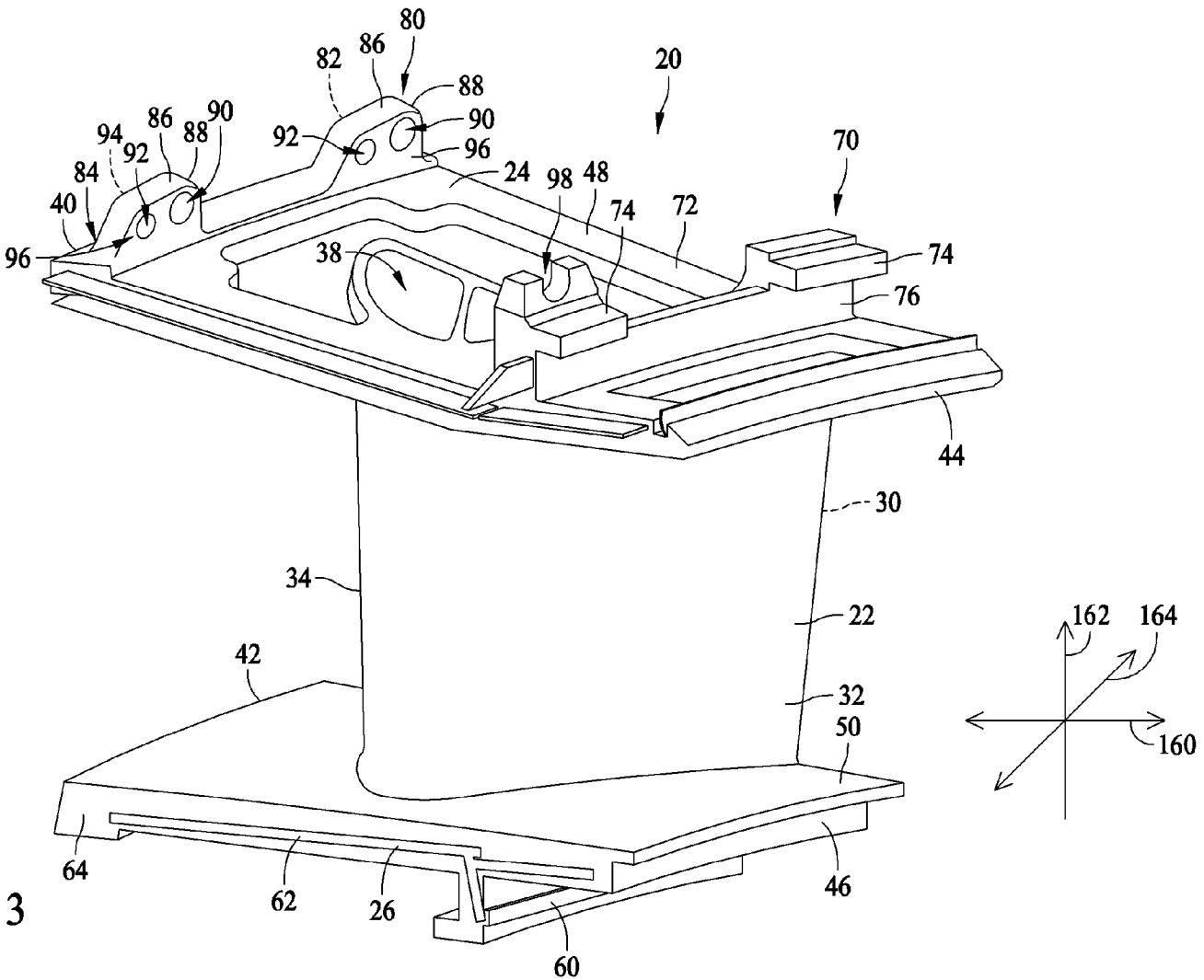
FIG. 3 is a perspective view of the turbine nozzle shown in FIG. 2.

FIG. 2 is a side view of an exemplary turbine nozzle 20 that may be used with a gas turbine engine, such as gas turbine engine 10 (shown in FIG. 1). FIG. 3 is a perspective view of turbine nozzle 20. FIG. 3 is an illustration of an exemplary embodiment of a first stage turbine nozzle segment 20 that may be used with combustion turbine engine 10 (shown in FIG. 1). As used herein, references to an "axial dimension," "axial direction" or an "axial length" are to be understood to refer to a measurement, distance or length, for example of a nozzle part or component, which extends along or is parallel to axis 100. Further, references herein to a "radial dimension," "radial direction" or a "radial length" are to be understood to refer to a measurement, distance or length, for example of a nozzle part or component, that extends along or is parallel to an axis 102, which intersects axis 100 at a point on axis 100 and is perpendicular thereto. Additionally, references herein to a "circumferential dimension," "circumferential direction", "circumferential length", "chordal dimension," "chordal direction", and "chordal length" are to be understood to refer to a measurement, distance or length, for example of a nozzle part or component, that extends along or is parallel to an axis 104, which intersects axis 100 and axis 102 at a point on axis 100, as shown in FIG. 3, and is perpendicular to axis 100 and axis 102. For example, the length of the arc formed around a turbine shaft by a component such as a turbine nozzle may be referred to as a chordal length.

In one embodiment, turbine nozzle 20 is one segment of a plurality of segments that are positioned circumferentially about the center axis of gas turbine engine 10 to form turbine nozzle assembly 12 within gas turbine engine 10. Turbine nozzle 20 includes at least one airfoil vane 22 that extends between an arcuate radially outer band or platform 24 and an arcuate radially inner band or platform 26. More specifically, in one embodiment, outer band 24 and inner band 26 are each integrally-formed with airfoil vane 22.

Airfoil vane 22 includes a pressure-side sidewall 30 and a suction-side sidewall 32 that are connected at a leading edge 34 and at a chordwise-spaced trailing edge 36 such that a cooling cavity 38 (shown in FIG. 3) is defined between sidewalls 30 and 32. Sidewalls 30 and 32 each extend radially between outer band 24 and inner band 26. In one embodiment, sidewall 30 is generally concave and sidewall 32 is generally convex.

Outer band 24 and inner band 26 each includes a leading edge 40 and 42, respectively, a trailing edge 44 and 46, respectively, and a platform body 48 and 50, respectively, extending therebetween. Airfoil vane(s) 22 are oriented such that outer band leading edge 40 and inner band leading edge 42 are upstream from vane leading edge 34 to facilitate outer band 24 and inner band 26 preventing hot gas injections along vane leading edge 34.

In one embodiment, inner band 26 includes an aft flange 60 that extends radially inwardly therefrom with respect to the center axis. More specifically, aft flange 60 extends radially inwardly from inner band 26 with respect to a radially inner surface 62 of inner band 26. Inner band 26 also includes a forward flange 64 that extends radially inwardly therefrom. In one embodiment, forward flange 64 is positioned at inner band leading edge 42 and extends radially inwardly from inner surface 62.

As shown in FIG. 2, in one embodiment, outer band 24 includes an aft flange 70 that extends generally radially outwardly therefrom. More specifically, aft flange 70 extends radially outwardly from outer band 24 with respect to a radially outer surface 72 of outer band 24. Further, a projection 74 extends in an axial direction from an aft surface 76 of aft flange 70, as shown in FIG. 2. Outer band 24 also includes a forward flange 80 that extends radially outwardly therefrom. Forward flange 80 is positioned between outer band leading edge 40 and aft flange 70, and extends radially outwardly from outer band 24. In one embodiment, an upstream surface 82 of forward flange 80 is offset with respect to leading edge 40. As shown in FIG. 2, upstream surface 82 defines a shoulder 84, such that flange upstream surface 82 is substantially planar from a flange surface 86 to shoulder 84.

Referring further to FIG. 3, in one embodiment, forward flange 80 is discontinuous and includes at least one circumferentially-spaced radial tab 88 that extends radially outwardly from outer surface 72. In this embodiment, each turbine nozzle 20 includes two tabs 88 each defining a pin bore 90 and a fastener bore 92. Each tab 88 forms an upstream surface 94 and a substantially parallel downstream surface 96.

Figure 4:
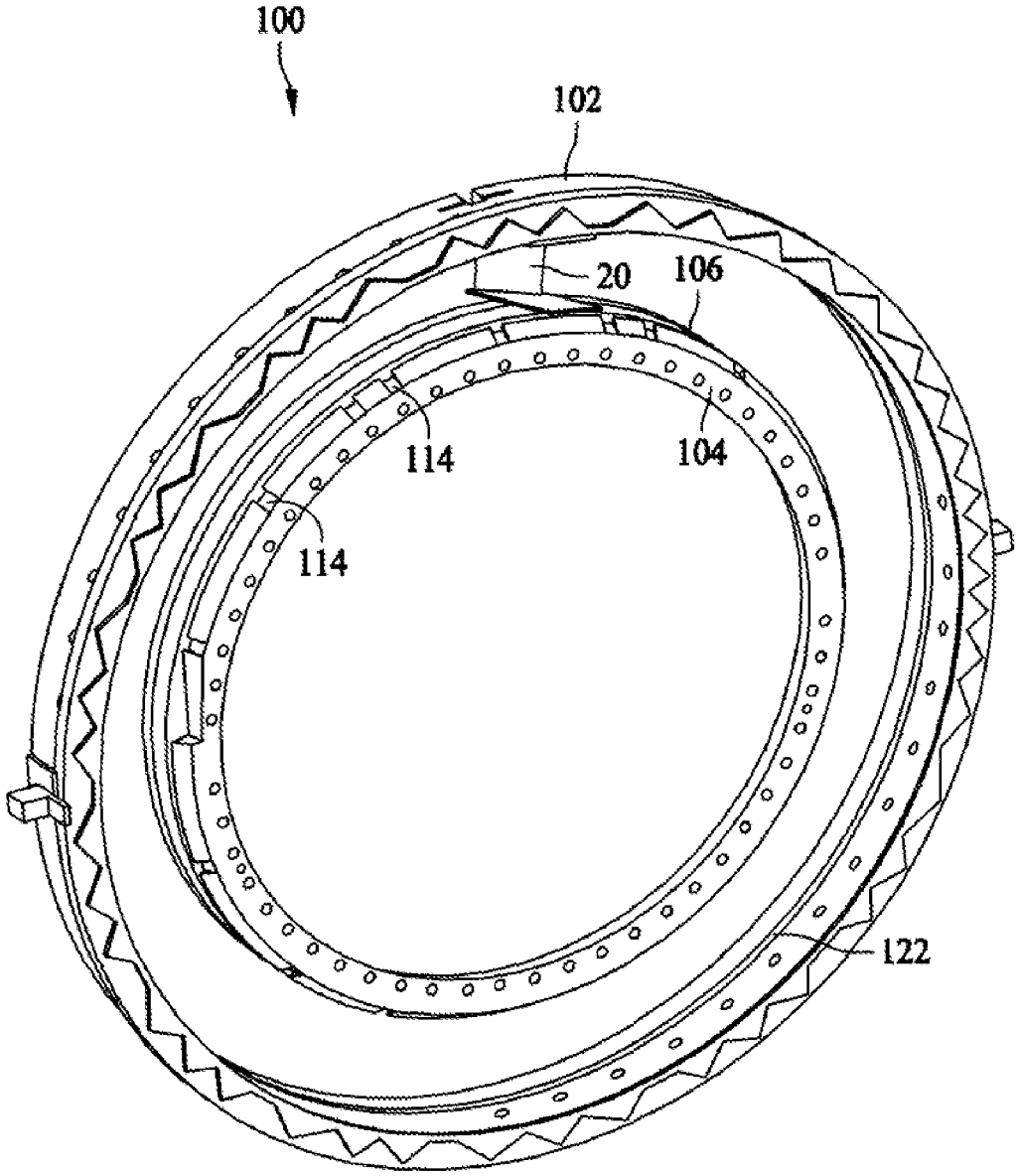
FIG. 4 is a perspective view of a retention assembly that may be used with the gas turbine engine shown in FIG. 1.
Figure 5:
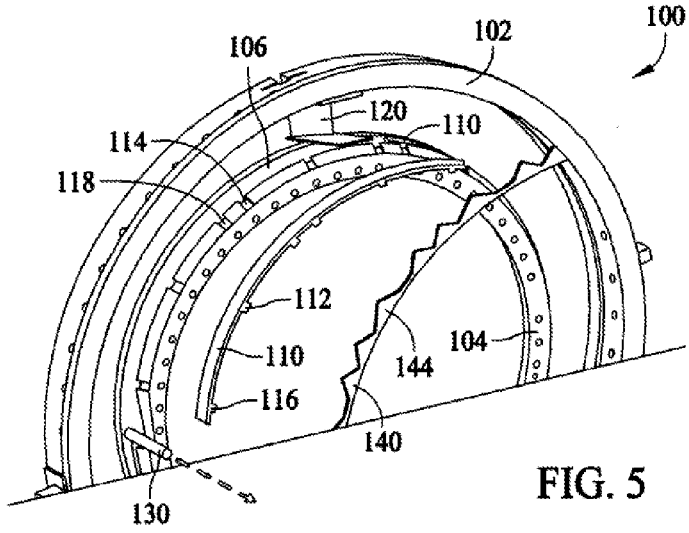
FIG. 5 is an exploded partial perspective view of the retention assembly shown in FIG. 4.
Figure 6:
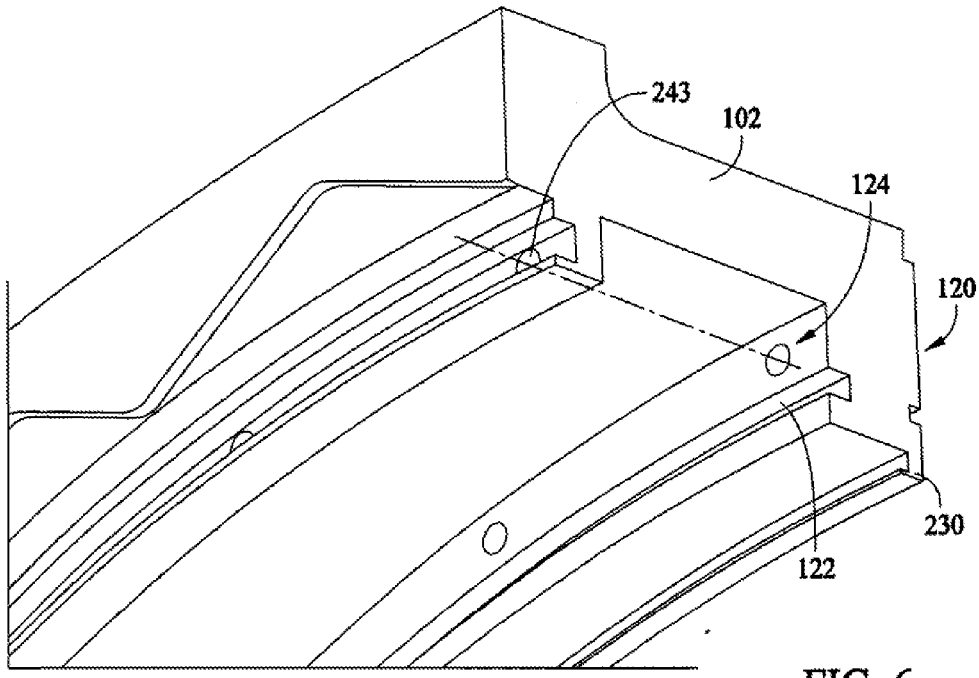
FIG. 6 is a partial perspective view of an outer retaining ring of the retention assembly shown in FIG. 4.

FIG. 4 is a perspective view of a retaining assembly 100 including a radial outer retaining ring 102 and a radial inner retaining ring 104 that may be used with a plurality of turbine nozzles 20, such as shown in FIGS. 2 and 3, forming turbine nozzle assembly 12. FIG. 5 is a partial exploded perspective view of retaining assembly 100 shown in FIG. 4. FIG. 6 is a partial perspective view of outer retaining ring 102 shown in FIG. 4. In one embodiment, a plurality of turbine nozzles 20 are positioned between and coupled to outer retaining ring 102 and inner retaining ring 104 to form turbine nozzle assembly 12. In a particular embodiment, a plurality of turbine nozzles 20, such as forty-eight (48) turbine nozzles 20, are positioned within retaining assembly 100 and circumferentially about inner retaining ring 104 to form turbine nozzle assembly 12 within gas turbine engine 10.

Referring to FIGS. 2 and 4-6, in one embodiment, aft flange 60 is positioned to contact a shoulder 106 defined at an aft end 108 of inner retaining ring 104. With flange 60 contacting shoulder 106, a retention segment 110 (shown in FIG. 5) is coupled to inner retaining ring 104 to retain inner band 26 positioned with respect to inner retaining ring 104. In a particular embodiment, retention segment 110 defines a plurality of projections 112. Each projection 112 fits within a corresponding cavity 114 defined within inner retaining ring 104. Projection 112 defines an aperture 116 that is aligned with an aperture 118 defined within cavity 114. Any suitable fastener (not shown), such as a screw or a bolt, is threadedly positioned within aperture 116 and/or 118 to secure retention segment 110 to inner retaining ring 104.

As shown in FIGS. 5 and 6, outer retaining ring 102 includes an aft end flange 120. A channel 122 is defined within an inner surface 124 of aft end flange 120. Referring further to FIG. 2, projection 74 formed on aft flange 70 of outer band 24 is positioned within channel 122 to couple outer band 24 to outer retaining ring 102. With projection 74 positioned within channel 122, an anti-rotation pin 130 is positioned within a pin bore 243 (shown in FIG. 6) and corresponding slot 98 (shown in FIG. 3) defined in aft flange 70 to couple outer band 24 to outer retaining ring 102. As shown in FIG. 2, anti-rotation pin 130 is substantially parallel to the center axis of gas turbine engine 10, such that anti-rotation pin 130 is inserted and removed in a substantially axial direction with respect to gas turbine engine 10. As shown in FIG. 5, turbine nozzle 20 is secured with respect to outer retaining ring 102 by a retaining plate 140 coupled to outer retaining ring 102. As shown in FIG. 2, in one embodiment, a suitable fastener 142, such as a screw or a bolt, fastens retaining plate 140 to outer retaining ring 102 such that an outer surface 144 of retaining plate 140 is planar with leading edge 40 of nozzle 20.

In one embodiment, the present invention provides a method for removing a target turbine nozzle 20 from turbine nozzle assembly 12, for example to repair and/or replace the target turbine nozzle. Referring further to FIG. 5, a plurality of turbine nozzles 20 are positioned circumferentially about inner retaining ring 104 to form turbine nozzle assembly 12. In one embodiment, forty-eight (48) turbine nozzles 20 form turbine nozzle assembly 12. A plurality of anti-rotation pins 130 each retains a corresponding turbine nozzle 20 properly coupled to outer retaining ring 102. In this embodiment, fasteners, such as screws or bolts, which retain turbine nozzles 20 properly positioned within turbine nozzle assembly 12, are removed from retaining plate 140 and from corresponding retention segment 110. Retaining plate 140 is removed from a coupling position with respect to outer retaining ring 102. Similarly, retention segment 110 is removed from a coupling position with respect to inner retaining ring 104.

An anti-rotation pin 130 retaining a spacing turbine nozzle 20 positioned with respect to the target turbine nozzle is removed. In this embodiment, the spacing turbine nozzle 20 is positioned within retaining assembly 100 and at a circumferential distance about inner retaining ring 104 with respect to the target turbine nozzle 20. For example, fourteen turbine nozzles 20 may be positioned between the spacing turbine nozzle 20 and the target turbine nozzle 20. Each anti-rotation pin 130 coupling a corresponding turbine nozzle 20 positioned between the target turbine nozzle 20 and the spacing turbine nozzle 20 is removed. With the corresponding anti-rotation pin 130 removed, each turbine nozzle 20 is moved circumferentially about inner retaining ring 104 to expose seals coupling adjacent turbine nozzles 20. The target turbine nozzle 20 is moved forward in an axial direction to remove the target turbine nozzle 20 from turbine nozzle assembly 12. The target turbine nozzle 20 is replaced with a new turbine nozzle 20 or repaired. The adjacent turbine nozzles 20 are then slid back into proper position about inner retaining ring 104. Each corresponding anti-rotation pin 130 is inserted through the corresponding turbine nozzle 20 to couple turbine nozzle 20 to outer retaining ring 102. Retaining plate 140 and retention segment 110 are reinstalled to complete assembly of retention assembly 100 and retain turbine nozzle assembly 12 with respect to aft end 14 of combustor duct 16.

Figure 7:
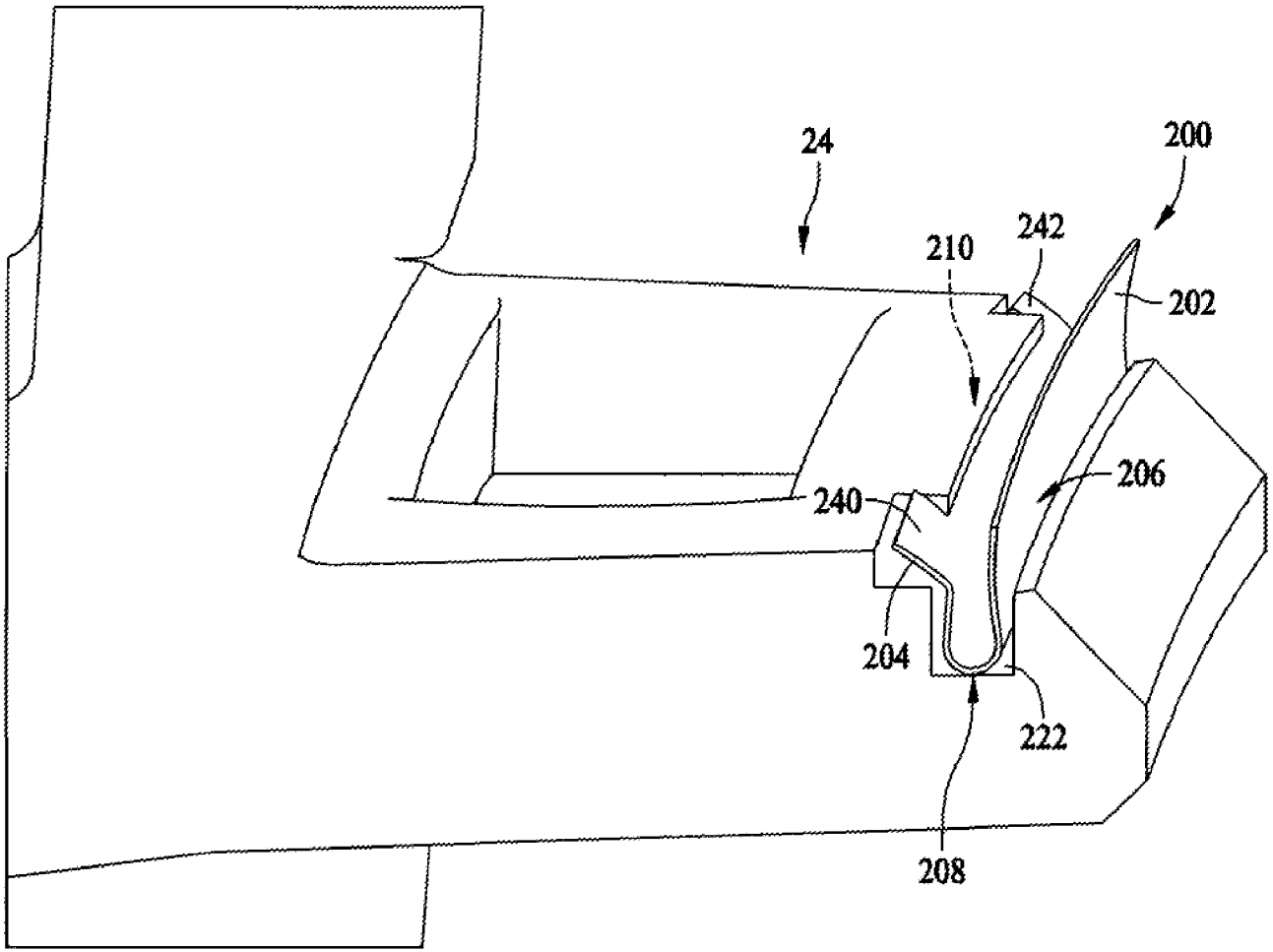
FIG. 7 is a partial perspective view of the turbine nozzle shown in FIG. 3.
Figure 8:
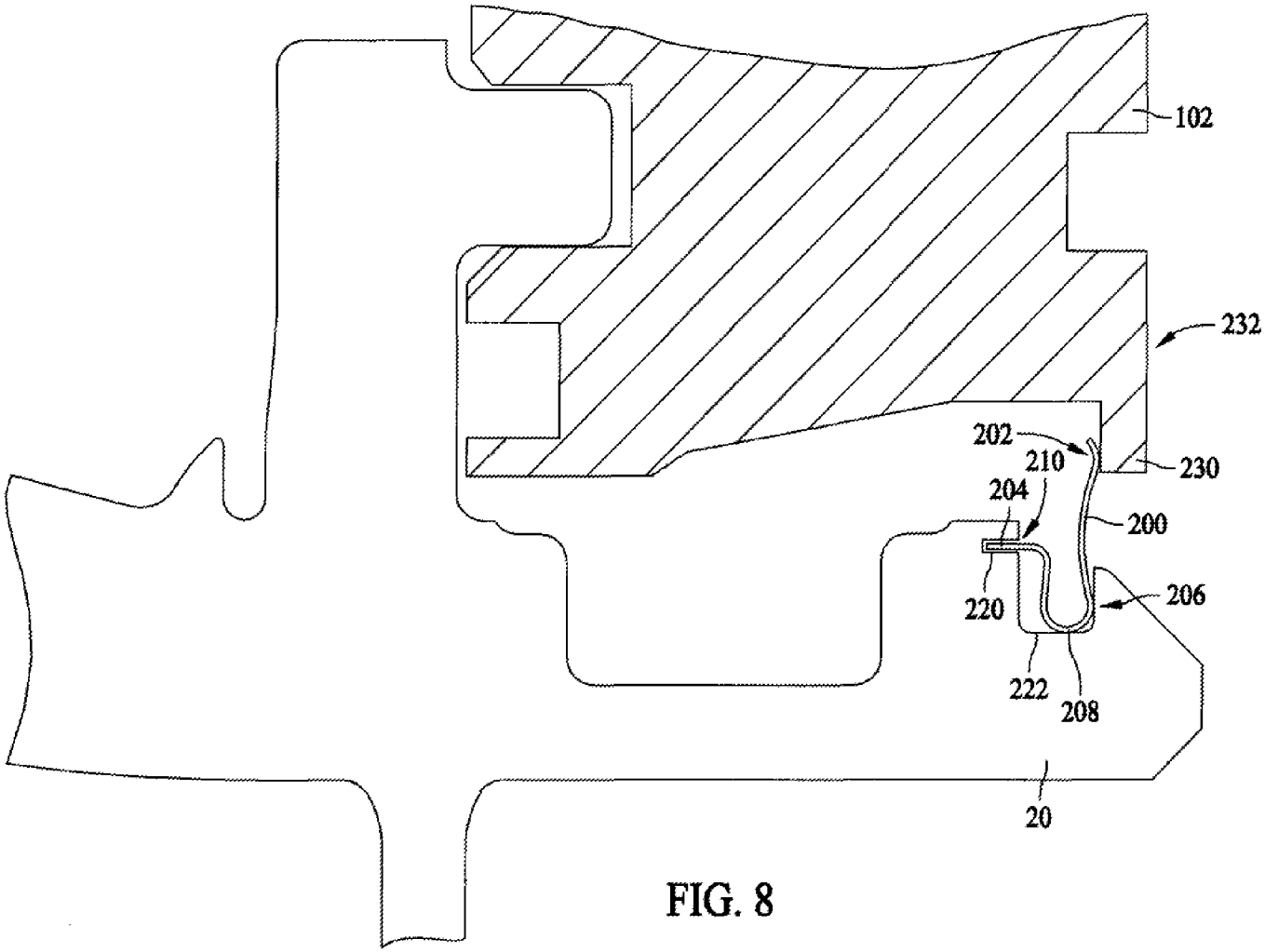
FIG. 8 is a partial sectional view of the turbine nozzle shown in FIG. 3.

FIG. 7 is a partial perspective view of outer band 24. FIG. 8 is a sectional view of the portion of outer band 24 shown in FIG. 7. In one embodiment, a retention seal 200 is configured to facilitate coupling nozzle 20 to outer retaining ring 102. As shown in FIGS. 7 and 8, seal 200 includes a first end 202, a generally opposing second end 204, and a body 206 extending therebetween. In this embodiment, body 206 includes an insertion portion 208 that transitions into a retention portion 210 defined at second end 204. Retention portion 210 is inserted into a slot 220 defined at trailing edge 44 of outer band 24 with insertion portion 208 positioned within a passage 222 defined at trailing edge 44. With seal 200 properly positioned within passage 222, first end 202 extends radially outwardly to contact or interfere with a flange 230 formed at an aft end 232 of outer retaining ring 102 to facilitate forming a seal and retaining nozzle 20 with respect to outer retaining ring 102. In a particular embodiment, tabs 240 and 242, as shown in FIG. 7, are formed at opposing end portions of seal 200 and configured to maintain retention portion 210 properly positioned within slot 220 and/or insertion portion 208 properly positioned within passage 222. Insertion portion 208 is generally U-shaped and extends from first end 202, and retention portion 210 extends from insertion portion 208 to second end 204. Accordingly, insertion portion 208 has an arcuate shape. In one embodiment, seal 200 is fabricated from a resilient material that resists deformation. In a particular embodiment, seal 200 is fabricated from a shape memory material. In an alternative embodiment, seal 200 is fabricated from any material that enables seal 200 to function as described herein.

The above-described method and apparatus for assembling a turbine nozzle assembly facilitates easy maintenance and/or replacement of nozzle segments and seals. More specifically, the method and apparatus facilitate removal of a target turbine nozzle from a turbine nozzle assembly positioned within a retention assembly. As a result, the turbine nozzle assembly can be reliably and efficiently maintained in proper operating condition.

Exemplary embodiments of a method and apparatus for assembling a turbine nozzle assembly are described above in detail. The method and apparatus is not limited to the specific embodiments described herein, but rather, steps of the method and/or components of the apparatus may be utilized independently and separately from other steps and/or components described herein. Further, the described method steps and/or apparatus components can also be defined in, or used in combination with, other methods and/or apparatus, and are not limited to practice with only the method and apparatus as described herein.

While the invention has been described in terms of various specific embodiments, those skilled in the art will recognize that the invention can be practiced with modification within the spirit and scope of the claims.

What is claimed is:

1. A retention seal assembly comprising:

an outer retaining ring coupled to an aft end of a gas turbine engine combustor;

a turbine nozzle coupled to said outer retaining ring, said turbine nozzle comprising an outer band, said outer band having a leading edge and an opposing trailing edge, said trailing edge defining a slot; and a retention seal having a first end positioned within said slot, a generally opposing second end contacting said outer retaining ring, and a body extending between said first end and said second end, said body further comprises an insertion portion positioned within a passage formed in said outer band, said retention seal fabricated from a resilient material and configured to facilitate coupling said turbine nozzle to said outer retaining ring.

2. A retention seal in accordance with claim 1 wherein said insertion portion transitions into a retention portion defined at said first end, said retention portion inserted into said slot.

3. A retention seal in accordance with claim 1 wherein said second end extends radially outwardly and interferes with a flange formed at an aft end of said outer retaining ring, said second end configured to facilitate forming a seal and retaining said nozzle with respect to said outer retaining ring.

4. A retention seal in accordance with claim 1 further comprising at least one tab formed at said first end configured to maintain at least one of said retention portion positioned within said slot and said insertion portion positioned within said passage.

5. A retaining assembly for use with a combustor turbine nozzle assembly, said retaining assembly comprising:

a first retaining ring coupled to an aft end of a gas turbine engine combustor, and comprising a leading edge and an opposite trailing edge;

a second retaining ring coupled radially inward from the first retaining ring and extending circumferentially about a center axis of the combustor, said second retaining ring comprises a shoulder extending circumferentially about an outer periphery of said second retaining ring, said shoulder is sized to receive a portion of the turbine nozzle assembly therein;

a seal member comprising a first end coupled within a slot defined within an outer band of the turbine nozzle assembly, a second end coupled to said first retaining ring, and a body extending between said first end and said second end, said body further comprises an insertion portion positioned within a passage formed in said outer band, said first and second retaining rings facilitate coupling said retaining assembly to the turbine nozzle assembly.

6. A retaining assembly in accordance with claim 5, wherein said second retaining ring forms a flange positioned adjacent said shoulder.

7. A retaining assembly in accordance with claim 5 further comprising a retention segment coupled to said second retaining ring, said retention segment configured to retain the portion of the turbine nozzle assembly received within said shoulder in position with respect to said second retaining ring.

8. A retaining assembly in accordance with claim 7 wherein said retention segment comprises a plurality of projections each sized for insertion in a respective cavity defined within said second retaining ring, said first retaining ring comprises a channel defined therein, said channel sized to receive a second portion of the turbine nozzle assembly therein, wherein said second portion is positioned within said channel and configured to couple said turbine nozzle assembly to said first retaining ring.

* * * * *